United States Patent [19]

Willsher

[11] Patent Number: 5,009,282

[45] Date of Patent: Apr. 23, 1991

[54] FOLDING STEPS

[76] Inventor: Philip Willsher, 21, Afan Terrace, Cwmavon, Port Talbot, United Kingdom

[21] Appl. No.: 424,218

[22] PCT Filed: Dec. 12, 1988

[86] PCT No.: PCT/GB88/01085

§ 371 Date: Oct. 10, 1989

§ 102(e) Date: Oct. 10, 1989

[87] PCT Pub. No.: WO89/05390

PCT Pub. Date: Jun. 15, 1989

[30] Foreign Application Priority Data

Dec. 10, 1987 [GB] United Kingdom ..... 8728893

[51] Int. Cl.[5] ..... E06C 1/387

[52] U.S. Cl. ..... 182/88; 182/35; 182/129; 182/159

[58] Field of Search ..... 182/88, 35, 156, 159, 182/33.5, 129

[56] References Cited

U.S. PATENT DOCUMENTS

| | | | |
|---|---|---|---|
| 538,145 | 4/1895 | Allen | 182/159 |
| 1,681,879 | 8/1928 | Putnam | 182/33.5 |
| 3,311,190 | 3/1967 | Naumann | 182/88 |
| 3,481,429 | 12/1969 | Gaede | 182/88 |
| 4,135,604 | 1/1979 | Ryan | 182/91 |

FOREIGN PATENT DOCUMENTS 506200 11/1919 France .

*Primary Examiner*—Reinaldo P. Machado

*Attorney, Agent, or Firm*—Body, Vickers & Daniels

[57] ABSTRACT

A folding step structure (7) comprises an elongate base (11) to be laid on or parallel to a ground surface (1); a frame (15) connected to the base; a step (14) connected to the frame such that the frame and the step member are together pivotal, about pivot points (20, 21) towards one end of the base, between a first limit position in which the step is parallel to, and closely spaced from, the ground surface at a location towards the other end of the base, in which limit position the frame is closely adjacent the base, and a second limit position in which the step is supported above the base; and a bracing strut (24) for securing the step and the frame in the second limit position.

9 Claims, 5 Drawing Sheets

FOLDING STEPS

The present invention is concerned with folding steps.

Folding steps are used in kitchens, warehouses, offices and the like where an elevated cupboard or shelf cannot be easily reached by someone standing on the ground. Folding steps are employed where floor space is limited, the steps being generally folded so as to take up a minimum of floor space, with the step portion(s) folded so as to lie in a substantially vertical plane when in the stowed condition.

I have now devised a folding step which can be stored underneath work units, cupboards or the like.

According to the present invention, therefore, there is provided a folding step structure, which comprises:

an elongate base member adapted to be laid on or parallel to a ground surface;

a frame structure and a step member which are together pivotal, about pivot points towards one end of said base member, between a first limit position in which said step member is disposed substantially parallel to, and closely spaced from, said ground surface at a location towards the other end of said base member, in which limit position said frame structure is in close juxtaposition to said base member, and a second limit position in which said step member is supported above said base member; and means for securing said step member and said frame structure in said second limit position.

The step structure according to the invention is particularly suitable for stowing under a cupboard, a kitchen unit (such as a cooker), a bedroom unit (such as a wardrobe), a filing cabinet, a shelf unit or the like. It is particularly preferred that the step structure should be arranged to slide out from under the cupboard or the like in the manner of a drawer, for which purpose, runners are preferably provided in the plinth under the cupboard or the like. The step structure may be provided with means for raising the step member as the structure is pulled out from underneath the cupboard or the like.

The frame structure is typically pivotally connected both to the base member and to the step member; the frame structure may comprise opposed pairs of side struts, each of said pairs being pivotally connected to one edge of the step member.

Preferred embodiments of the invention will now be described by way of example with reference to the accompanying drawings, in which.

Figure 1:
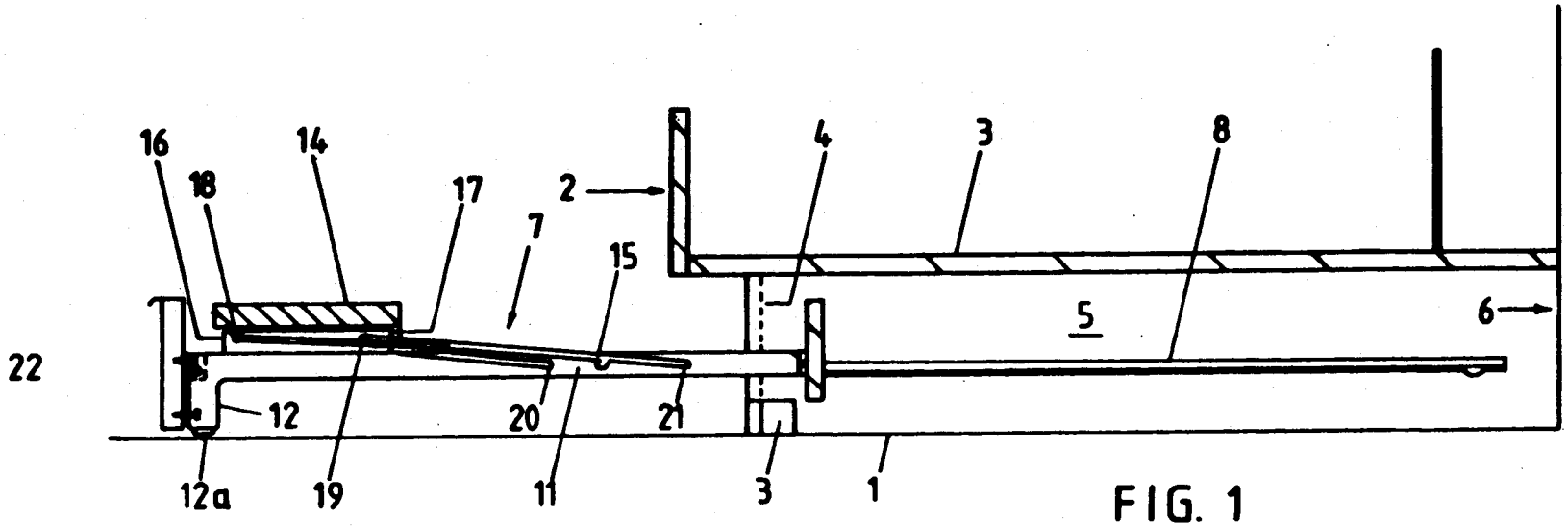
FIG. 1 is a schematic side elevation of a preferred embodiment of step structure, in folded condition, ready for stowing under a cupboard.

Referring to FIG. 1, there is shown a generally horizontal ground surface 1 on which is placed a cupboard 2 having a cupboard floor 3 supported by a plinth 4 such that there is a space 5 beneath the cupboard 2 extending from a building wall 6 to the plinth 4.

Slidably locatable in the space 5 is a step structure indicated generally by numeral 7. The step structure is located on runners 8 each running substantially along the entire depth of the space beneath cupboard 2. Step structure 10 comprises a base 11 having legs 12,13; a step 14; and a frame 15. Leg 12 typically has a rubber foot 12*a* to prevent slippage of the step when in the raised position Base 11 has an elongate groove along the length thereof (not shown) such that it can slide along runner 8.

In the position shown in FIG. 1, step 14 is generally parallel to base 11 and to the ground surface; the opposite edges 16,17 of step 14 are connected to frame 15 at a pair of pivot points 18,19. The other ends of frame 15 are connected to base 11 at a pair of pivot points 20,21. In the position shown in FIG. 1, the entire step structure 10 can be retracted beneath the cupboard, leavlng a fascia 22 which matches the plinth 4.

Figure 2:
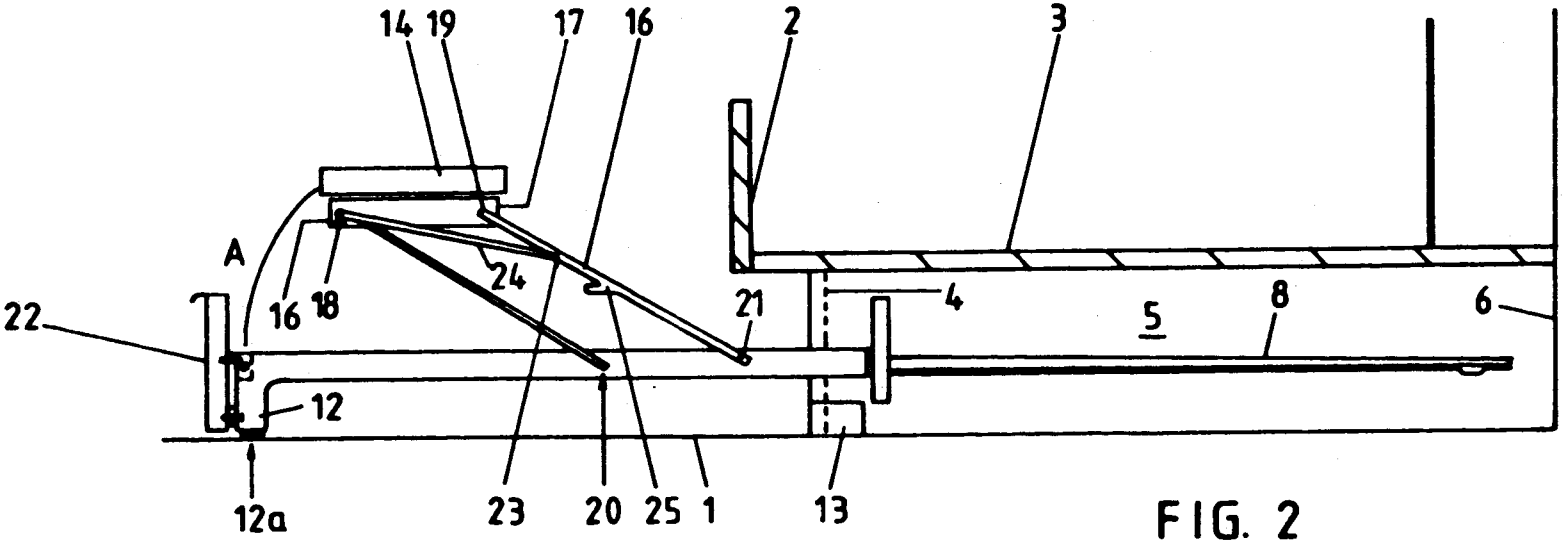
FIG. 2 is a side elevation of the step structure of FIG. 1, with the step in partly raised position.
Figure 3:
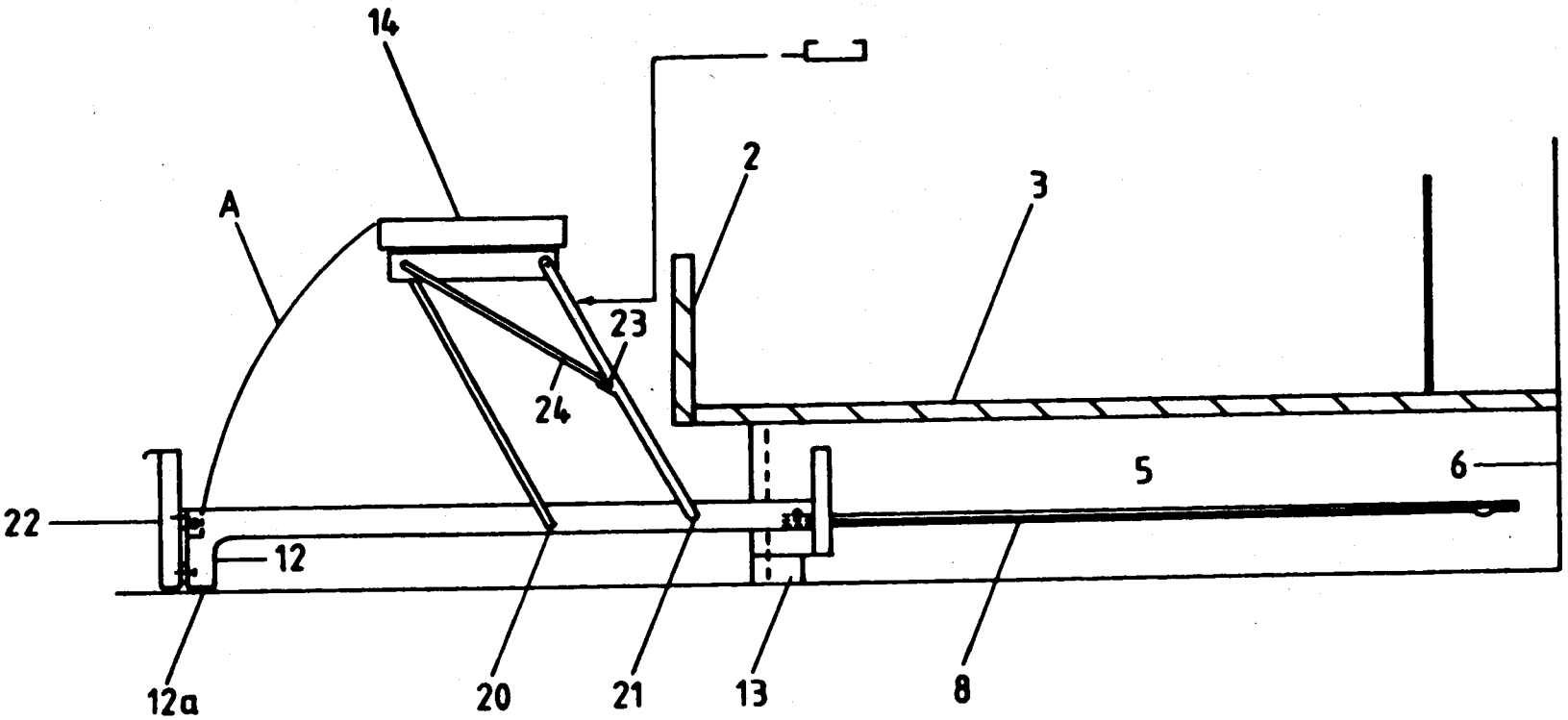
FIG. 3 is a further side elevation of the step structure of FIG. 1, with the step fully raised.
Figure 4:
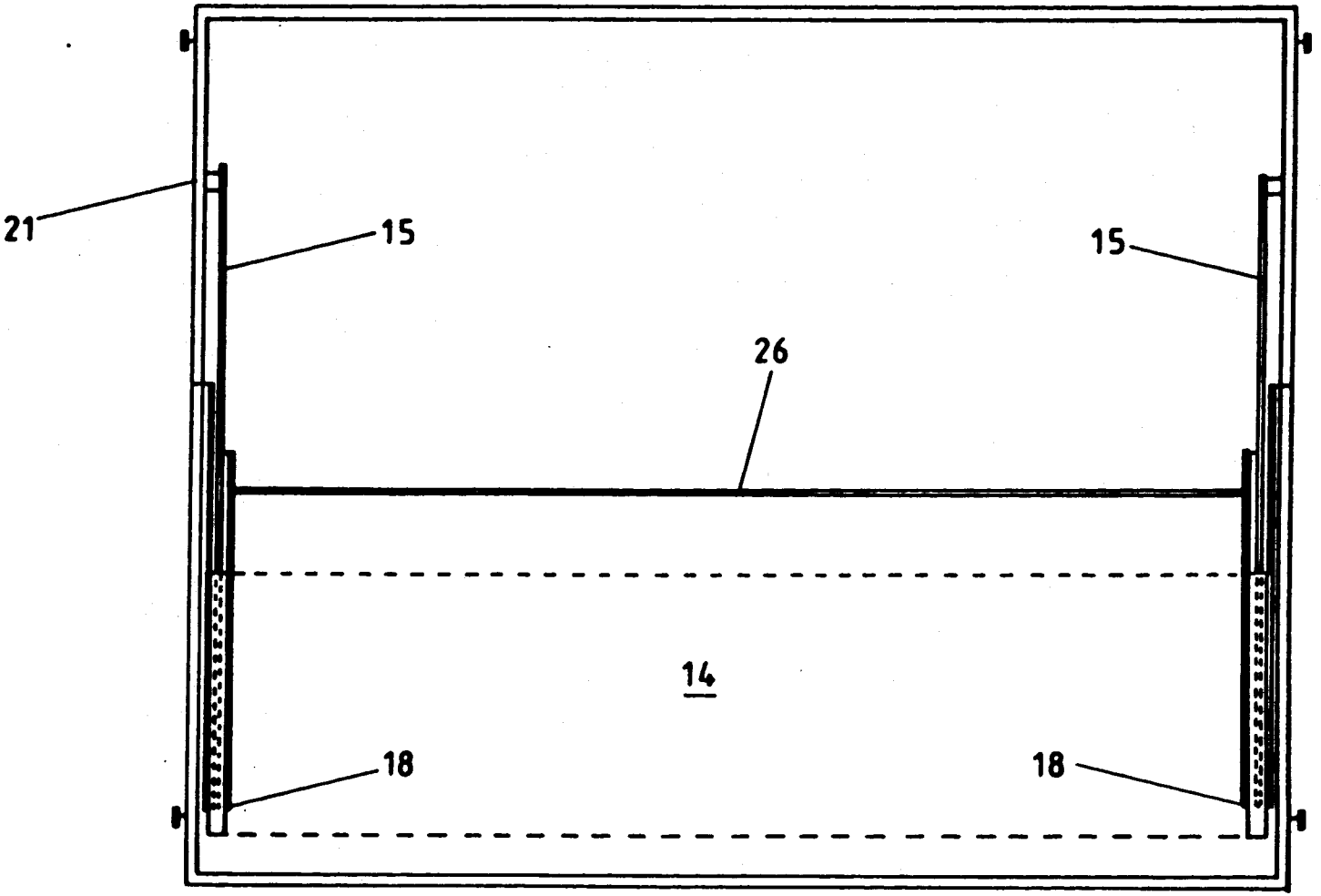
FIG. 4 is a plan view of the step structure in the folded condition of FIG. 1.
Figure 5:
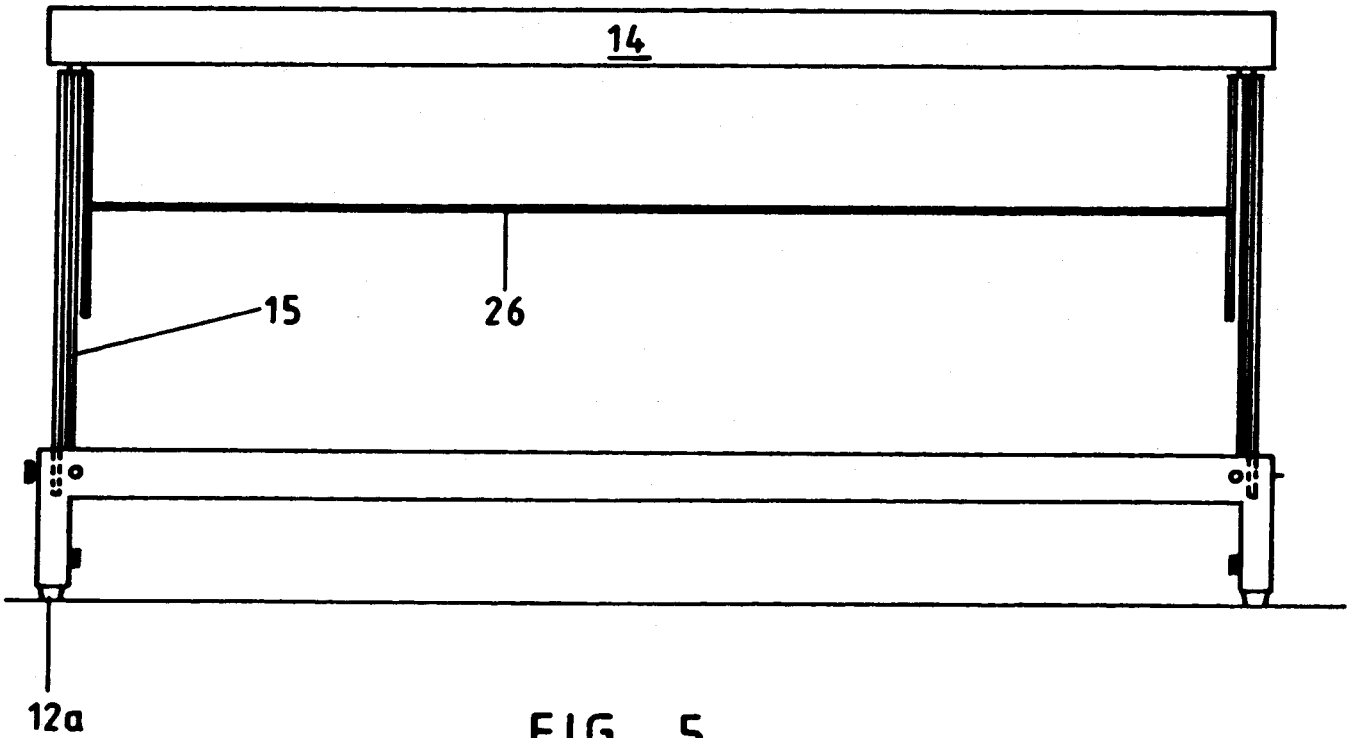
FIG. 5 is a front elevation of the step structure in the raised condition of FIG. 3.

The way in which the step can be elevated is illustrated in FIGS. 2 and 3, in which like parts are denoted by like reference numerals. The step 14 is moved about arc A, while the end 23 of bracing strut 24 slides along frame 15 (which is typically of channel section) until it reaches a recessed portion 25 where it locks in place (see FIG. 3). Further security is provided to the step in its erected position by the provision of a transverse brace 26 (see FIGS. 4 and 5).

Figure 6:
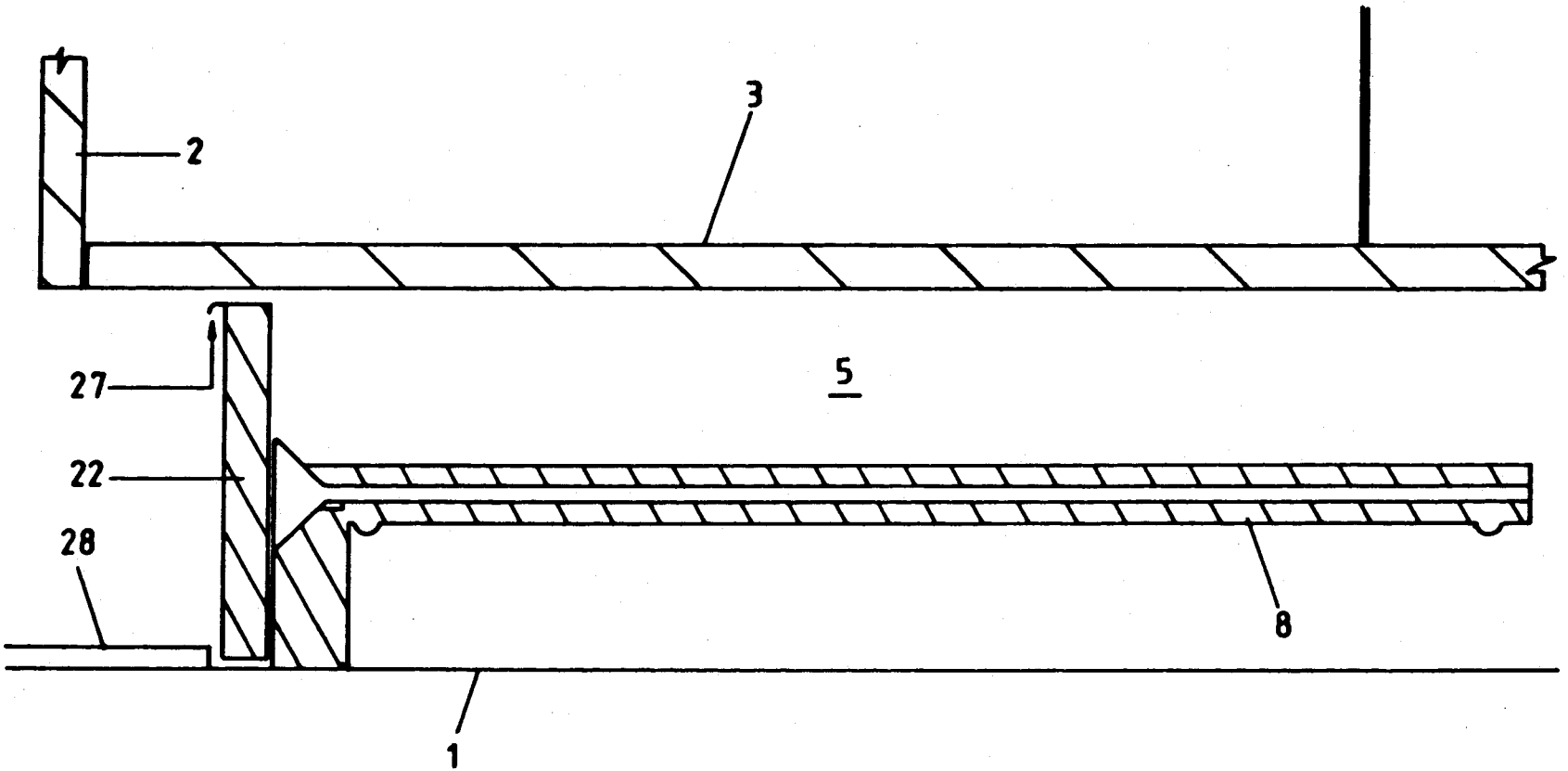
FIG. 6 is a side elevation showing certain modifications to the device of FIG. 1.

Referring to FIG. 6 of the drawings (in which parts like to those in FIGS. 1 to 5 are denoted by like reference numerals), the step structure is shown in the fully stowed position.

The fascia 22 is provided with a handle 27 by means of which the step structure can be manually pulled out from underneath the cupboard 2. The front end of the groove in the frame 11 is funnel-shaped in order to ensure that the runner 8 can be accurately located in the groove.

There is a small clearance between the cupboard floor 3 and the top of the folded step structure., this enables the latter to be pulled upwards (by means of the handle 27) as it is pulled outwards to allow for irregularities in the ground surface adjacent the plinth 4, for example if a tiled or other raised surface 28 is provided on the ground surface 1.

I claim:

1. A folding step structure, which comprises:

(a) an elongate base member adapted to be laid on or parallel to a ground surface;

(b) a frame structure connected to said base member;

(c) a step member connected to said frame structure such that said frame structure and said step member are together pivotal, about pivot points towards one end of said base member, between a first limit position in which said step member is disposed substantially parallel to, and closely spaced from, said ground surface at a location towards the other end of said base member, in which limit positions said frame structure is in close juxtaposition to said base member, and a second limit position in which said step member is supported substantially parallel to said ground surface and substantially spaced above said base member; and (d) securing means for securing said step member and said frame structure in said second limit position.

2. A folding step structure according to claim 1, wherein said base member is provided with a plinth for covering a space beneath an item of furniture.

3. A folding step structure according to claim 2, wherein said plinth is provided with a handle permitting said base member to be pulled from under said item of furniture.

4. A folding step structure according to any of claims 1 to 3, which is provided with means for permitting said base member to slide above said ground surface.

5. A folding step structure according to claim 4, wherein said means for permitting sliding comprises a pair of runners, one at each side of said base member.

6. A folding step structure according to any of claims 1 to 5, wherein said frame structure comprises opposed pairs of side struts, each of which pairs is pivotally connected to a respective edge of said step member.

7. A folding step structure according to claim 6, wherein said securing means comprises an opposed pair of bracing struts, one for each pair of side struts.

8. A folding step structure according to any of claims 1 to 7, in which said base structure is provided with legs which engage with said ground surface.

9. A folding step structure according to claim 8, wherein said legs are provided with means for preventing a slippage thereof relative to said ground surface.

* * * * *